US006735897B1

(12) United States Patent
Schmitter et al.

(10) Patent No.: US 6,735,897 B1
(45) Date of Patent: May 18, 2004

(54) FIRE CONTROL AUTHORIZATION SYSTEM FOR A FIREARM

(76) Inventors: Edward P. Schmitter, 115 Pineview Dr., Eastover, SC (US) 29044; Jason Lee Hitchcox, 220 Cottonwood Way, Columbia, SC (US) 29229; Thomas Jerome Ruemping, 755 Westbrook Rd., Clayton, OH (US) 45415

( * ) Notice: Subject to any disclaimer, the term of this patent is extended or adjusted under 35 U.S.C. 154(b) by 0 days.

(21) Appl. No.: 10/268,591

(22) Filed: Oct. 10, 2002

Related U.S. Application Data

(63) Continuation-in-part of application No. 09/519,579, filed on Mar. 6, 2000, now abandoned, and a continuation-in-part of application No. 09/886,445, filed on Jun. 21, 2001, now abandoned.

(51) Int. Cl.[7] ..... F41A 17/00

(52) U.S. Cl. ..... 42/70.01; 42/70.11; 42/70.06; 42/84

(58) Field of Search ..... 42/70.01, 70.11, 42/70.06, 84

(56) References Cited

U.S. PATENT DOCUMENTS 4,488,370 A * 12/1984 Lemelson ..... 42/70.01
4,682,435 A * 7/1987 Heltzel ..... 42/70.01
4,793,085 A * 12/1988 Surawski et al. ..... 42/84
5,619,817 A * 4/1997 Jones ..... 42/70.01
5,704,153 A * 1/1998 Kaminski et al. ..... 42/70.11
6,237,271 B1 * 5/2001 Kaminski ..... 42/70.06
6,286,240 B1 * 9/2001 Collins ..... 42/70.08
6,321,478 B1 * 11/2001 Klebes ..... 42/84
6,363,647 B2 * 4/2002 Kaminski ..... 42/70.11

* cited by examiner

*Primary Examiner*—Michael J. Carone
*Assistant Examiner*—M. Thomson
(74) *Attorney, Agent, or Firm*—Michael A. Mann; Nexsen Pruet Adams Kleemeier, LLC

(57) ABSTRACT

An authorization system for a firearm includes a personal device worn by the authorized user, modifications to the firearm's fire control system, and an authorization control circuit carried in the backstrap of the firearm handle. The authorization control circuit controls the fire control system and communicates with the personal device. In particular, the authorization control circuit will send a first coded signal to the personal device via an ultrasonic transponder and wait for a coded response. If the personal device is worn by a user and is within range, properly oriented and has received a correct code, it will respond to the signal by sending a coded response. If the correct coded response is not received, the authorization control circuit signals a brake solenoid located near the trigger bar to move to a locked position where it will cam the trigger bar out of engagement with the sear as the trigger is pulled. Consequently, the trigger bar will not move the sear and the firearm will not fire. If a correct coded response is received the brake solenoid moves to an unlocked position wherein it will not alter the trigger bar's normal rearward movement, thereby allowing engagement of the sear and firing of the firearm.

20 Claims, 8 Drawing Sheets

FIRE CONTROL AUTHORIZATION SYSTEM FOR A FIREARM

CROSS REFERENCE TO RELATED APPLICATIONS:

The present application is a continuation in part of U.S. application Ser. No. 09,519,579, filed Mar. 6, 2000, now abandon and a continuation in part of U.S. application 09/886,445, filed Jun. 21, 2001 now abandoned.

STATEMENT REGARDING FEDERALLY SPONSORED RESEARCH OR DEVELOPMENT

Not Applicable.

REFERENCE TO A SEQUENCE LISTING, A TABLE, OR A COMPUTER PROGRAM LISTING COMPACT DISK APPENDIX

Not Applicable.

BACKGROUND OF THE INVENTION

The present invention relates to firearm security in general and to firearms with authorization systems in particular.

There have been numerous improvements to firearm security over the years. However, there is an inherent paradox in firearm security. On one hand, a secure weapon may require several steps to be taken before it can be fired. For example, it may have to be removed from a locked cabinet. Ammunition may be stored separately. A trigger lock may need to be unlocked. Safeties may have to be moved to the "off" position. On the other hand, the user; who may be a law enforcement officer, may need to fire it quickly in emergencies to save lives or to save his or her own life. Inevitably, compromises are made in the design and storage of firearms between security and ready usability.

Historically, firearm safeties were of the type that, when the user wanted to fire the weapon, he or she moved a safety lever or catch from the "on" position to the "off" position. Other safeties have been developed to complement this basic approach, all emphasizing that the user must intend to discharge the weapon in order for the weapon to be in a condition for it to be fired, or to be "enabled." None of these systems questions the authority of the user who intends to fire the firearm.

More recently, firearms have been designed with authorization systems. These systems attempt to verify that the user is someone who is permitted to fire the firearm. An unauthorized user cannot fire the firearm equipped with an authorization system. Typically, these systems rely on some means of identification: the user enters a code on a keypad on the firearm or has a key that unlocks the firearm, or the firearm has the capability to read a particular individual's fingerprint. Another type of authorization system relies on a "personal device" worn by the authorized user that communicates using radio-frequency transmitters and receivers with electronic circuits carried in the firearm. Indeed, many improvements and variations have been made in existing authorization systems.

The nature of the use of the firearm must be considered in the design of an authorization system. For example, a firearm designed for shooting for sport can be designed with greater limitations on when it can be enabled. The design of authorization systems for law enforcement firearms are more challenging. Law enforcement officers must be prepared to fire their firearms on short notice. However, a law enforcement officer must sometimes grapple with a suspected criminal, risking the possibility that the suspected criminal could turn the officer's firearm on the officer. Thus, in an instant, an ideally designed authorization system should give the firearm the capability to switch repeatedly and automatically between being enabled and being disabled as the struggle for control of the firearm continues.

Other design considerations must be taken into account as well when designing an authorization system for a law enforcement firearm. Authorization systems must not be easily defeated by those criminals who understand how these systems work. Authorization systems that rely on battery power must have a ready-to-fire condition even if the battery is dead. Accordingly, there remains a need for an authorization system that operates reliably, that does not drain its batteries quickly, and that is particularly suited for law enforcement use.

SUMMARY OF THE INVENTION

According to its major aspects and briefly recited, the present invention is an authorization system for a firearm designed especially for law enforcement use. The system includes a detector that can sense an authorization signal from the user and a firearm that responds appropriately to the authorization signal or to an absence of one.

The firearm queries the user for the authorization signal shortly after the firearm has been grasped and removed from the holster. If an authorization signal is not obtained, pulling the trigger will not cause the firearm to discharge. Specifically, a failure to authorize causes a brake solenoid to be held in the safe "no fire" position in which the solenoid cams the trigger bar away from the sear. On the other hand, if authorization is obtained, the solenoid does not significantly affect the normal, rearward movement of the trigger bar.

A key feature of the present invention is the use of a particular type of solenoid placed in direct engagement with the top surface of the trigger bar. The solenoid has a rotatable armature assembly that can be locked in place or allowed to rotate based on whether or not the solenoid has received a small electrical current or not. The small electrical current to the coil of the solenoid stator assembly causes the plate to lock in place. The armature assembly carries a camming pin that will directly engage the top surface of the trigger bar. When locked, the pin cams the trigger bar out of engagement with the sear; when unlocked, the bar rotates the pin out of the way on its rearward travel to engage the sear as usual. This arrangement simplifies alignment of components, minimizes battery drain, increases reliability and allows the system to be in "ready to fire" condition at all times.

The use of a holster switch in combination with a grip switch to initiate authorization is another important feature of the present invention. The holster switch activates the battery and the grip switch activates the authorization system. Thus, the authorization system does not require touching or pulling the trigger itself to operate, merely the gripping of the unholstered firearm.

The logic circuitry of the present invention is another of its important features. The logic is based on a fire-enabled mode in the event of failure, rather than a fire-disabled mode, although the system can be easily modified to perform in a fire-disabled mode. Furthermore, a short delay is built into the authorization logic to permit the user to fire it, regardless of authorization, when the gun is first pulled from the holster. This allows a "quick-draw" firing, regardless of authorization, based on the presumption that the one pulling it from its holster is the authorized user and the need to fire the gun is immediate. However, the delay is short and in a fraction of a second after the delay, authorization will be confirmed.

The combination of circuit logic and the type of solenoid is another important feature of the present invention. In addition to having an authorization logic oriented to best suit the needs of law enforcement personnel, the logic also minimizes battery consumption. Although these sometimes competing goals may seem to be natural assumptions to make, how they are realized in practice is not intuitive but instead requires careful planning and compromise. For example, the power-consuming authorization process is only done when the gun is out of the holster and in someone's grasp. Once done, reauthorization is not performed unless the gun is released for more than a pre-selected, short interval. There is also a "sleep mode" when the gun is out of the holster but not within the user's grasp. In this mode it draws very little power. In the holster it draws none. Only when the person grasping the gun is not authorized, which is likely a very, very small percentage of the time, does the system require power for the solenoid.

Other features and their advantages will become apparent to those skilled in the art of firearm design from a careful reading of the Detailed Description of Preferred embodiments, accompanied by the following drawings.

BRIEF DESCRIPTION OF THE DRAWINGS

In the figures.

DETAILED DESCRIPTION OF PREFERRED EMBODIMENTS

Figure 1A:
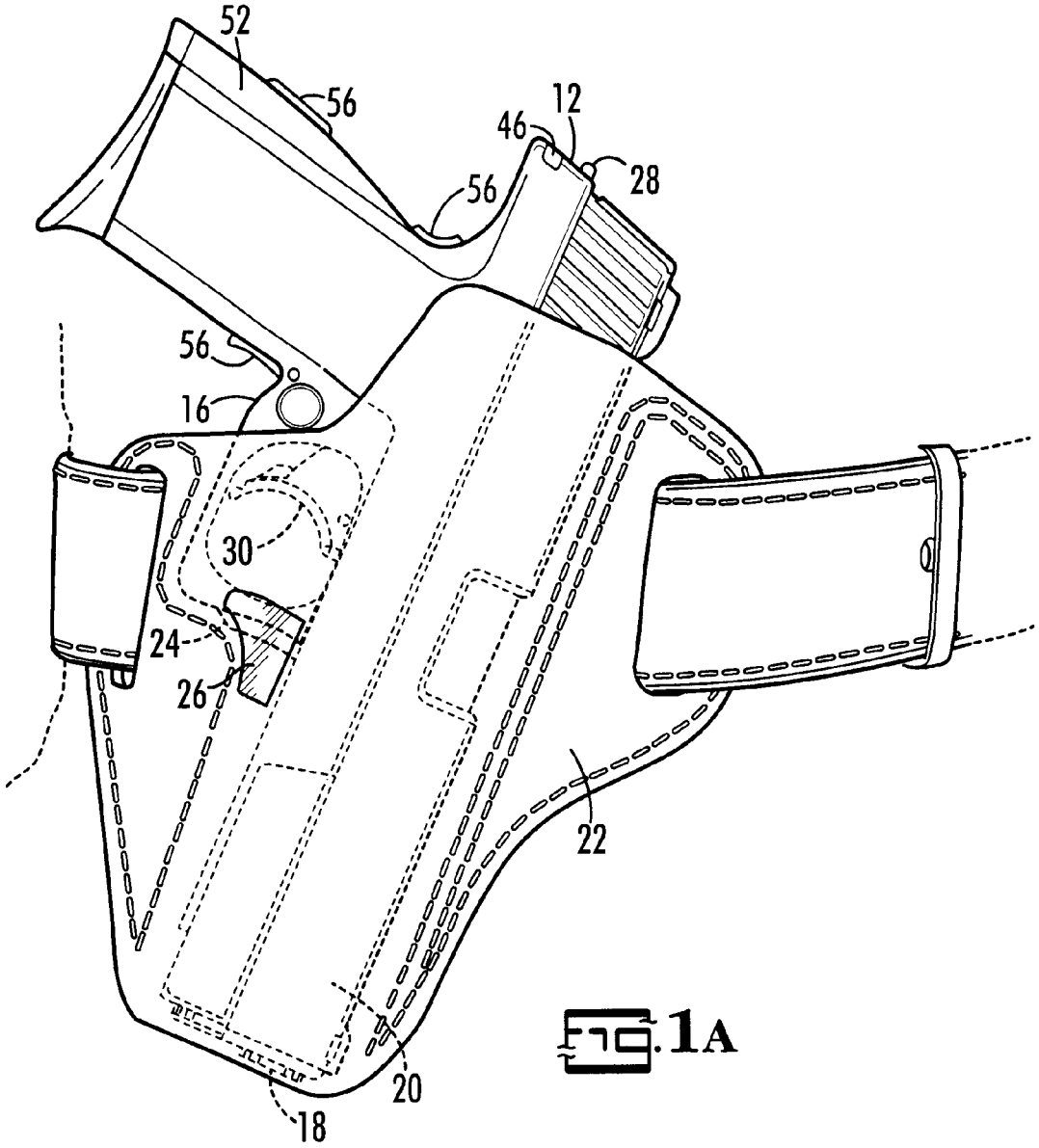
FIG. 1A is a side view of a firearm in a holster, according to a preferred embodiment of the present invention, showing the holster switch and the grip switch.

The present invention is a firearm with an authorization system. The authorization system will disable the firearm so that it will not fire if the user is an unauthorized user. The present invention includes a firearm, a holster and a device for emitting an authorization signal from the user of the firearm.

Referring now to FIGS. 1–5 an embodiment of the present firearm 10 with the present authorization system is illustrated. In most respects, a firearm, generally indicated by reference number 10, is a conventional firearm, here illustrated as a semiautomatic firearm. It has all of the components of a typical firearm, including, for example, a frame 12 with a handle 14 and trigger guard 16, a barrel 18, a slide 20, and a breech block. However, it has additional components as will be described.

Firearm 10 is shown in FIG. IA in a holster 22 having a holster switch 24 that is preferably a reed switch held open by a magnet attached to holster 22. Holster switch 24 closes upon the removal of firearm 10 from holster 22, as shown in FIG. 11B. Once closed, as will be more fully described below, current from a battery will flow to power the authorization system.

Firearm 10 has a fire control system that includes a pivotally mounted trigger 30 and a trigger bar 62 that moves rearward in response to the pulling of trigger 30. When trigger bar 62 is moved rearward, it comes into alignment with a sear 64 so that it will catch sear 64 and move it rearward as well. Sear 64 loads the firing pin 36 against the firing pin spring until sear 64 releases firing pin 36, which is then propelled forward at the urging of the firing pin spring. The propelled firing pin 36 strikes the primer of a cartridge (not shown) in the breech block, detonating the powder in the cartridge. The exploding powder propels the cartridge bullet through barrel 18. The foregoing is conventional operation for a semi-automatic firearm 10.

In the present system, however, an authorization system can commandeer the fire control system to prevent it from operating in selected circumstances such as when the user is not authorized. There are certain, limited conditions, as will be described, when firearm 10 is in a "fire-enabled" mode. These include any time firearm 10 is in holster 22 and within a pre-selected interval of time after being withdrawn from holster 22. Furthermore, according to the present preferred embodiment for police use, the present authorization system, if it should fail, will fail in the "fire-enabled" mode.

Having firearm 10 enabled when in holster 22 or when not in a user's grasp limits battery drain. A third circumstance when firearm 10 is enabled without regard to the user's authorization occurs immediately after firearm 10 is pulled from holster 22. This exception exists as a trade-off, trading what is likely a police officer's need to fire quickly against the probability that an unauthorized person is drawing firearm 10 quickly from holster 22.

As the user grasps the handle 14 of firearm 10, the pressure of the hand of the user on any of three pressure sensors 56 carried by handle 14 will send a signal to an electrical control circuit 42, thus closing a grip switch (more fully described below) in electrical control circuit 42. The locations of sensors 56 are selected to be placed where a user would have to grip the firearm 10 in order to fire it. One sensor 56, for example, may be located at the web at the top rear of handle 14, another sensor 56 can be just below trigger guard 24, and a third at the middle of the back of handle 14, for example. The purpose of multiple grip sensors 56 and of using at least one of them to close a grip switch, is to initiate the authorization system based on the premise that firearm 10 is being grasped in a manner that would enable someone to fire it, rather than merely being touched or carried in some way that would not indicate an intention to fire. The closing of the grip switch upon receipt of pressure on pressure sensors 56 initiates the authorization system.

An alternate, preferred embodiment for pressure sensors are sensors based on capacitance. When a user touches or is close to these sensors, the capacitance of the user's body produces a signal in an electronic controller that in turn activates the authorization system. This system differs from the one based on pressure sensors in three respects. First the capacitance-based system is more sensitive than the pressure sensor-based system; the slightest touch or even proximity can activate the authorization system. Second, the capacitance-based system can be calibrated and can auto-calibrate to adjust for changes in conditions such as weather and in the handling of the gun so that the appropriate sensitivity activates the authorization system. Third, although the capacitance-based system can be subject to interference from radio frequency sources (unlike the pressure sensor system described above), the circuit can be built with an inductor in combination with the capacitor, forming a well-known resonance type circuit so that, when the handle is touched, the signal voltage to the controller will increase rather than decrease, and will fail in the "on" mode rather than in the "off" mode as would normally be the case if interference triggered the authorization system. In addition, capacitance switches can be added to the handle of the firearm in such a way that the firearm will not need to look any different than one that is not equipped with the present invention. Finally, capacitance switches are more rugged than pressure sensitive switches.

Unlike many prior art authorization systems, however, the user does not have to have a finger on trigger 30 or be in the process of pulling trigger 30 for the authorization system to be operational. Firearm 10 merely has to be in someone's grasp and free of holster 22.

The present authorization system depends on an authorizing signal from the user to firearm 10. Firearm 10 will initiate a coded query and "listen" for a response. The response is most preferably a unique, coded response to the authorized user or users but preferably at least a unique signal from a device 40 worn by the authorized user. Such a device is referred to herein as a personal device. However, it will be clear that technology that allows individuals to be sensed and uniquely identified could be adapted to be used in lieu of the use of personal device 40. Alternately, personal device 40 can be carried by holster 22 or the transponder of personal device 40 can be separated and worn somewhere on the body in an appropriate position relative to gun 10. In this case, personal device and transponder can be connected by wire or can be wireless.

If personal device 40 is carried by holster 22, a second switch (not shown) can be placed in holster 22 to be activated by the drawing of gun 10. This second holster switch supplies power to the transponder from a battery in personal device 40 so that the transponder does not always have to be in an "active" or "sleep" mode and so that the user does not have to remember to turn it on.

An electrical control circuit 42 causes a first ultrasonic transponder 46 carried by frame 12 to emit a coded ultrasonic burst. First ultrasonic transponder 46 is located in the rear of firearm 10 and oriented to emit the burst rearward. If the user is wearing personal device 40, it will respond via a second ultrasonic transponder 50 carried by device 40 as long as the "code" detected is acceptable. Second ultrasonic transponder 50, on personal device 40, will respond by transmitting a coded ultrasonic burst. The highly directional nature and ranging capabilities of the ultrasonic transponders 46, 50, as opposed to radio frequency transponders, assures that firearm 10 must be in the hand of the authorized user and generally pointed away from the user (see FIGS. 2 A&B) for first and second transponders 46, 50, to communicate. Thus, firearm 10 cannot be fired when pointed towards the wearer of personal device 40 or at a distance greater than "A" away from device 40.

If an ultrasonic burst is received from personal device 40 by the first ultrasonic transponder 46, the burst will be decoded and compared by electronic circuit 42 to those pre-designated authorization codes in memory and the signal travel time compared to that expected when the signal comes from a distance more than pre-selected distance "A".

Electrical control circuit 42 is preferably an integrated circuit with memory secured within an integral back strap 52 so that tampering cannot easily defeat the authorization system.

Many prior art authorization systems use solenoids to block a component of the fire control system of a firearm, such as the trigger, the sear, or the trigger bar. However, the present invention does not block the fire control mechanism; it "disconnects" it. By "disconnecting," it is meant that trigger 30, when disconnected, still moves when pulled, moving trigger bar 62 rearward, but firearm 10 does not fire because sear 64 is not moved by trigger bar 62. "Blocking" on the other hand means that trigger 30 does not move when pulled. This difference is important. If a component of the fire control system is blocked by a solenoid, a user who is not authorized may be able by sheer force to cause the rod of the solenoid or the blocked component to become damaged and thus defeat the authorization system. In the present system, no amount of force will enable the disconnected fire control system because trigger 30, trigger bar 62 and sear 64 are not blocked. They are, however, disconnected.

Figure 1B:
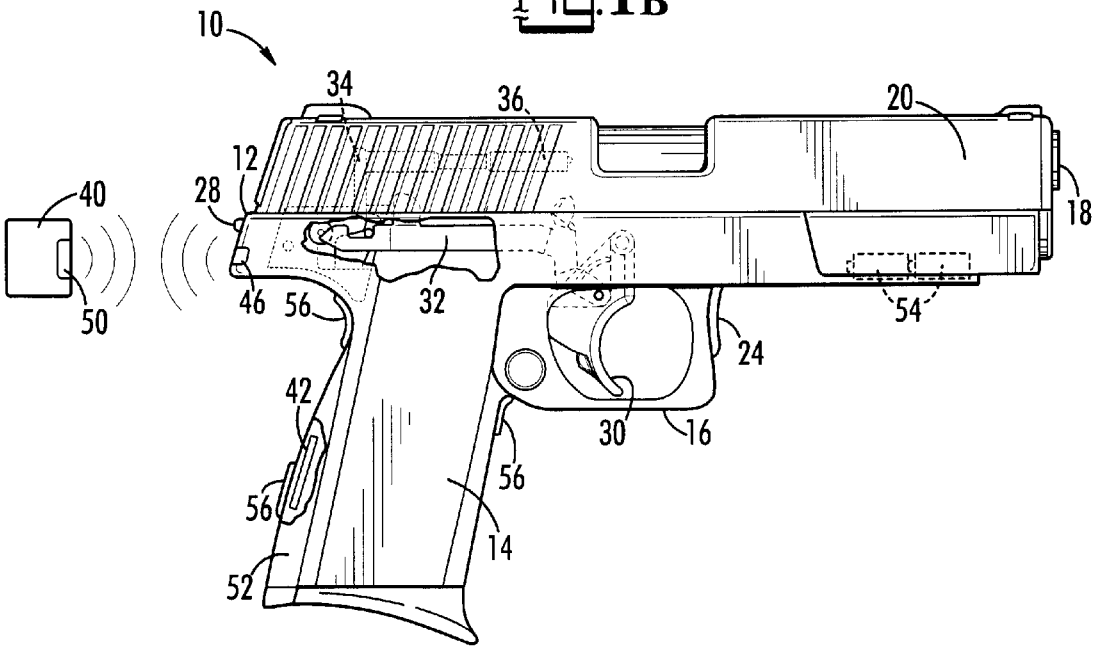
FIG. 1B is a side view of a firearm drawn from the holster, according to a preferred embodiment of the present invention, with the firearm partially cut away to show the fire control system and also showing the personal device within range.
Figure 1B:
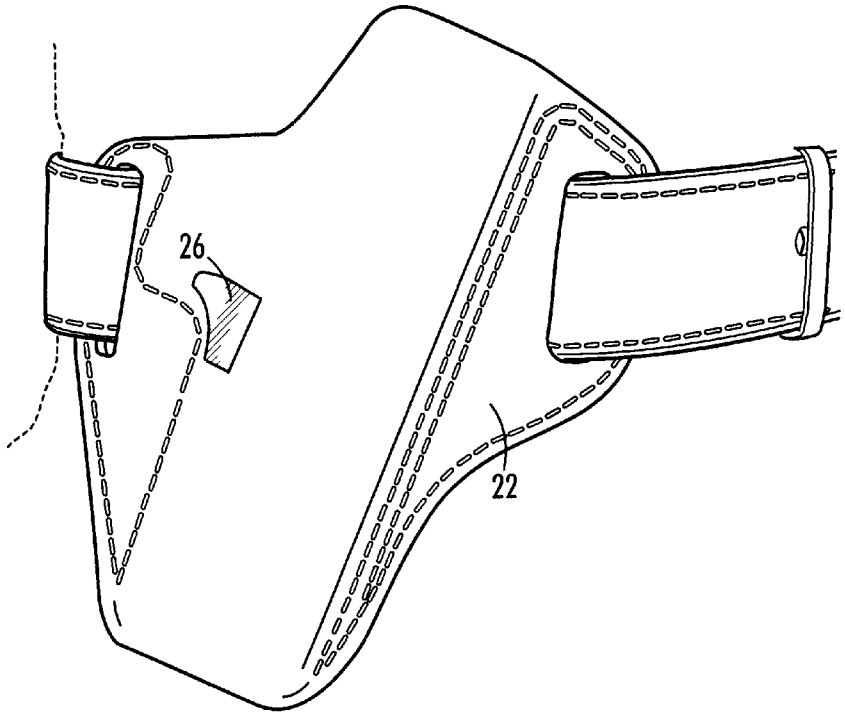
Figure 2A:
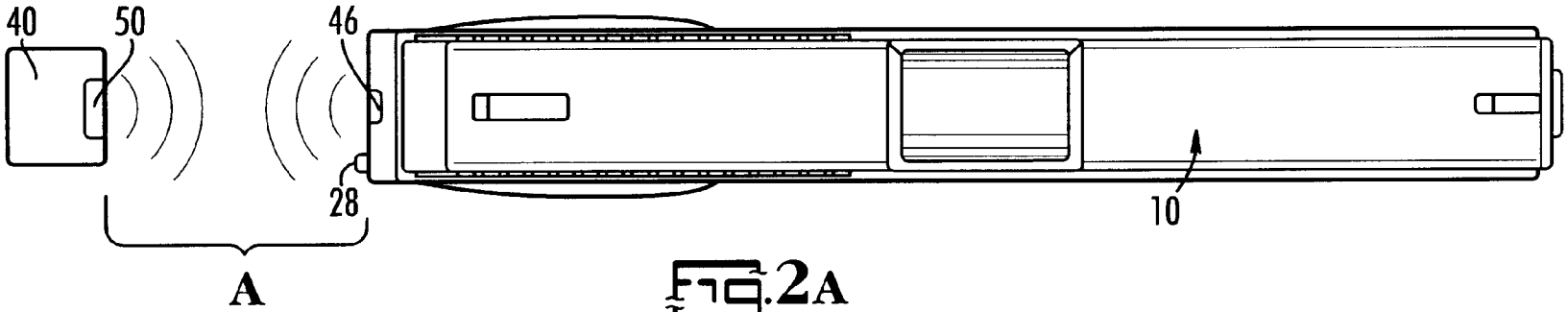
FIGS. 2A and 2B are top views that illustrate the directional and distance measurement nature of ultrasonic waves in an authorization system, according to a preferred embodiment of the present invention.
Figure 2B:
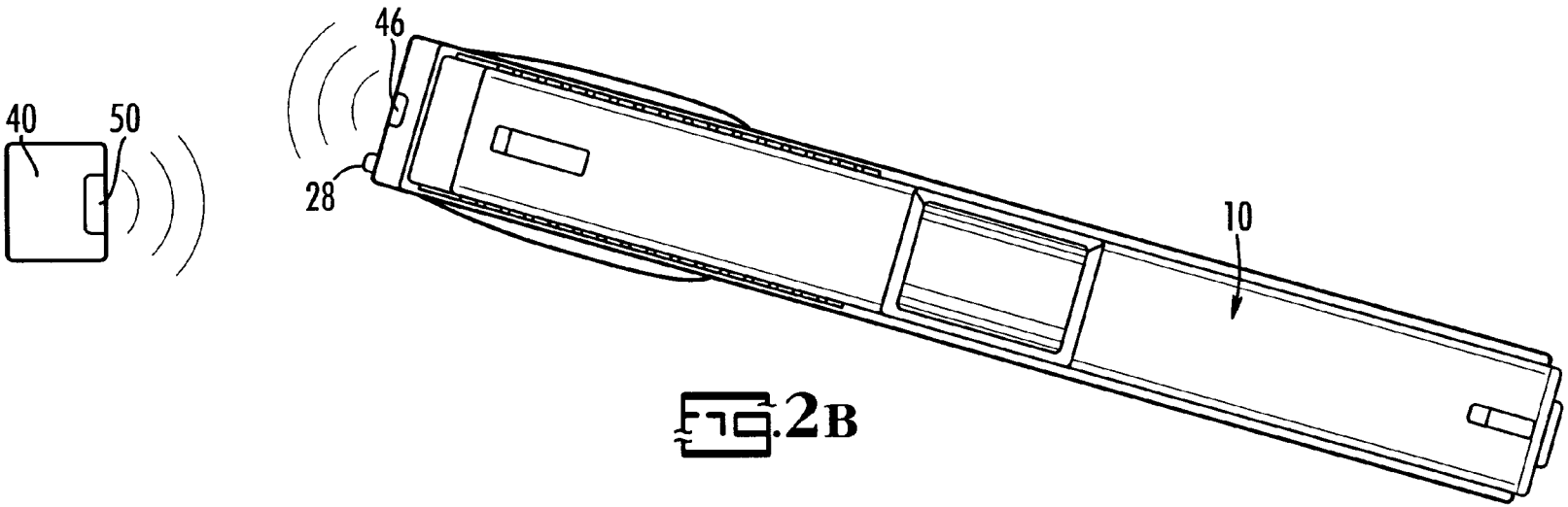

The present authorization system is powered by one or more batteries 54 stored in frame 14 shown below barrel 18, as seen in FIG. 1B.

Figure 3A:
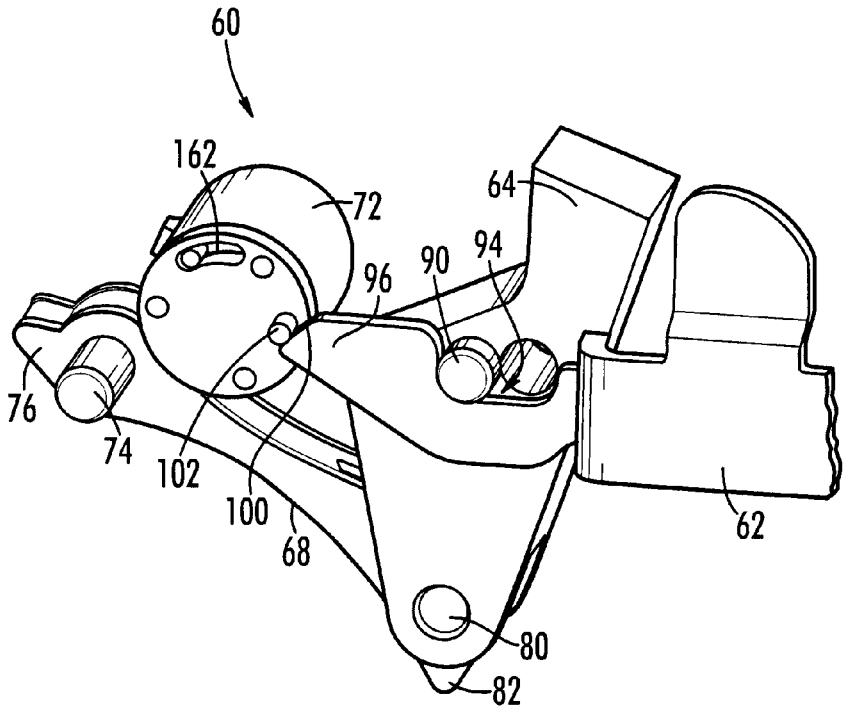
FIGS. 3A, 3B and 3C illustrate the structure and operation of the brake solenoid in controlling the trigger bar, with FIGS. 3A and 3B showing the brake solenoid in the "fire disabled" position and FIG. 3C showing the brake solenoid in the "fire enabled" position, according to a preferred embodiment of the present invention.
Figure 3B:
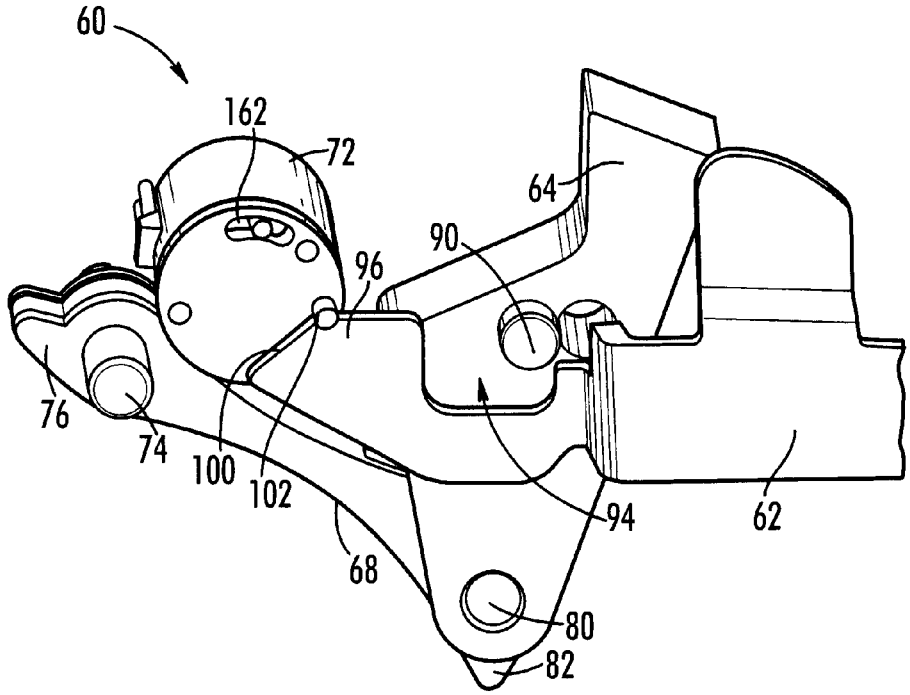
Figure 3C:
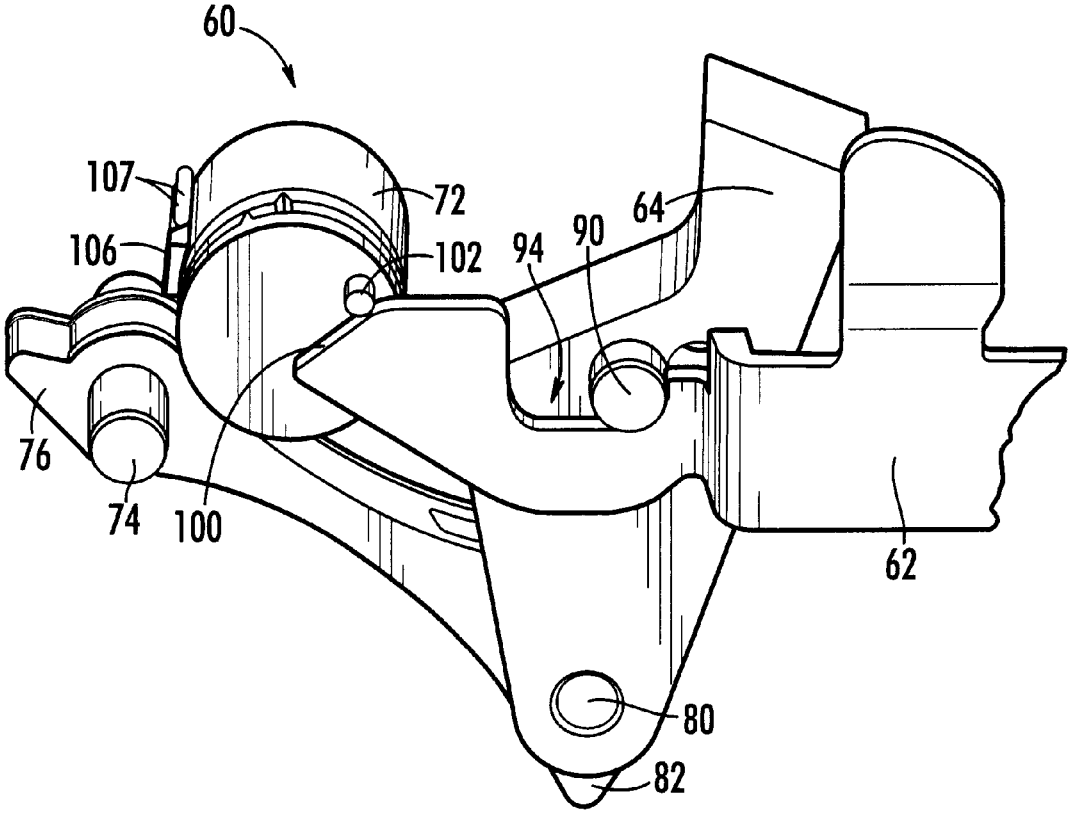

A preferred embodiment of the fire control system is illustrated in the sequence shown in FIGS. 3A–3C. This fire control system, generally indicated with reference number 60 comprises a trigger bar 62, a sear 64 that "floats" on a pivoting arm 68, and a brake solenoid 72.

Sear 64 may be urged rearward and downward against springs (not shown) as is taught by U.S. Pat. No. 5,806,225, for example, which illustrates a "floating sear." When urged downward, pivoting arm 68 pivots about a first pivot pin 74 on a first end 76 of pivoting arm 68, and sear 64 pivots about a second pivot pin 80 located on a second, opposing end 82 of pivoting arm 68.

The rearward movement of sear 64 (away from barrel 18) is controlled by the rearward movement of trigger bar 62 (which is, in turn, controlled by the rearward movement of trigger 30, not shown in FIGS. 3A–3C but described above in connection with FIG. 1B). To move sear 64 rearward, trigger bar 62 must engage and push a sear driver pin 90 mounted on the side of sear 64. A notch 94 is formed in trigger bar 62 that receives and controls the movement of sear driver pin 90 as long as sear driver pin 90 is riding within notch 94. If, however, trigger bar 62 is depressed to the point where sear driver pin 90 is not in notch 94, trigger bar 62 will fail to engage sear driver pin 90 and, consequently, to move sear 64 rearward.

Extension 96 of trigger bar 62, located at the end of trigger bar 62, opposing the connection between trigger bar 62 and the trigger 30 (FIG. 1B), has a camming edge 100. Camming edge 100 engages a solenoid pin 102 of brake solenoid 72. Brake solenoid 72 is held firmly in position in frame 12 by using at least one tab 106. As will be explained in detail below, rearward movement of trigger bar 62 will cause camming surface 100 to engage solenoid pin 102. If solenoid pin 102 is held firmly in place, it will cam trigger bar 62 downward, as illustrated in FIG. 3B, so that sear driver pin 90 is not in notch 94 and, accordingly, trigger bar 62 will fail to engage sear driver pin 90, and sear 64 will not be moved, thus preventing firearm 10 from being fired. If, however, solenoid pin 102 is permitted to rotate, then the rearward movement of trigger bar 62 will cause camming surface 100 to rotate solenoid pin upward. Then sear pin 90 remains in notch 92 and trigger arm 62 will engage sear driver pin 90 and load sear 64, thus allowing firearm 10 to be fired.

The angle at which solenoid pin 102 comes into contact with camming surface 100 should be selected to provide a smooth transition from a state of disengagement to one of engagement as trigger bar 62 is moved rearward; in other words, trigger bar 62 should not "catch" on solenoid pin 102. Power to solenoid 72 is provided by batteries 54 via wires 107, and causes solenoid pin 102 to be held in the position shown in FIGS. 3A and 3B. Without power, solenoid pin 102 is allowed to rotate. Camming surface 100 then rotates solenoid pin 102 up and out of the way on the rearward travel of trigger bar 62, as illustrated in FIG. 3C, by approximately 45 degrees counter-clockwise.

Figure 4A:
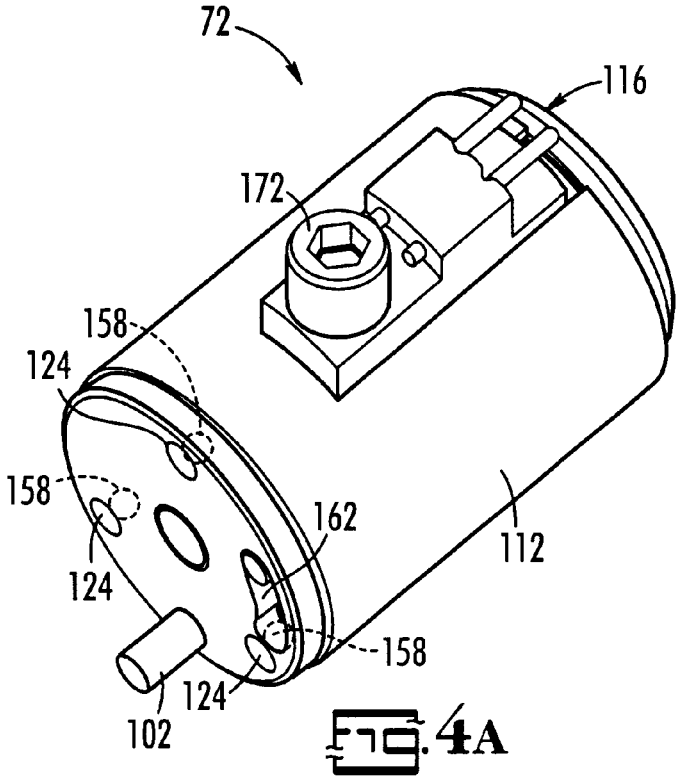
FIGS. 4A and 4B are perspective views of the brake solenoid of FIGS. 3A, 3B, and 3C illustrating its "fire disabled" and "fire enabled" positions.
Figure 4B:
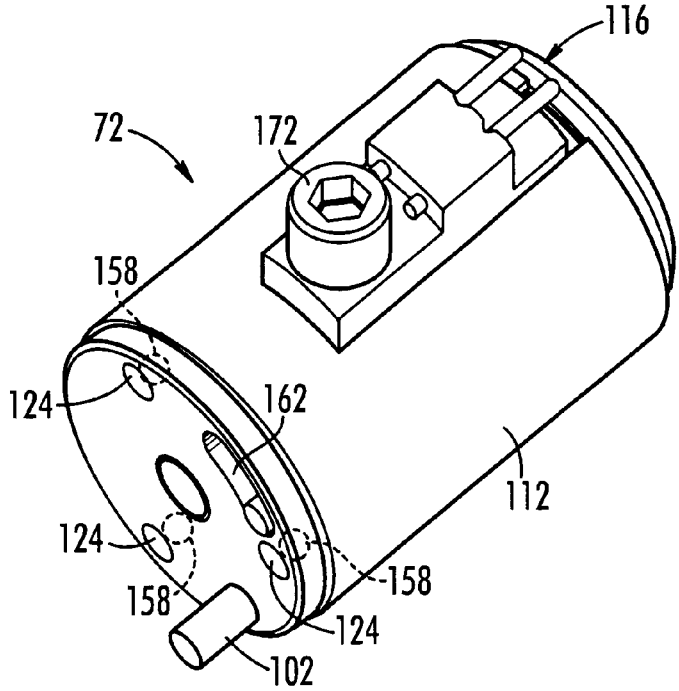
Figure 5:
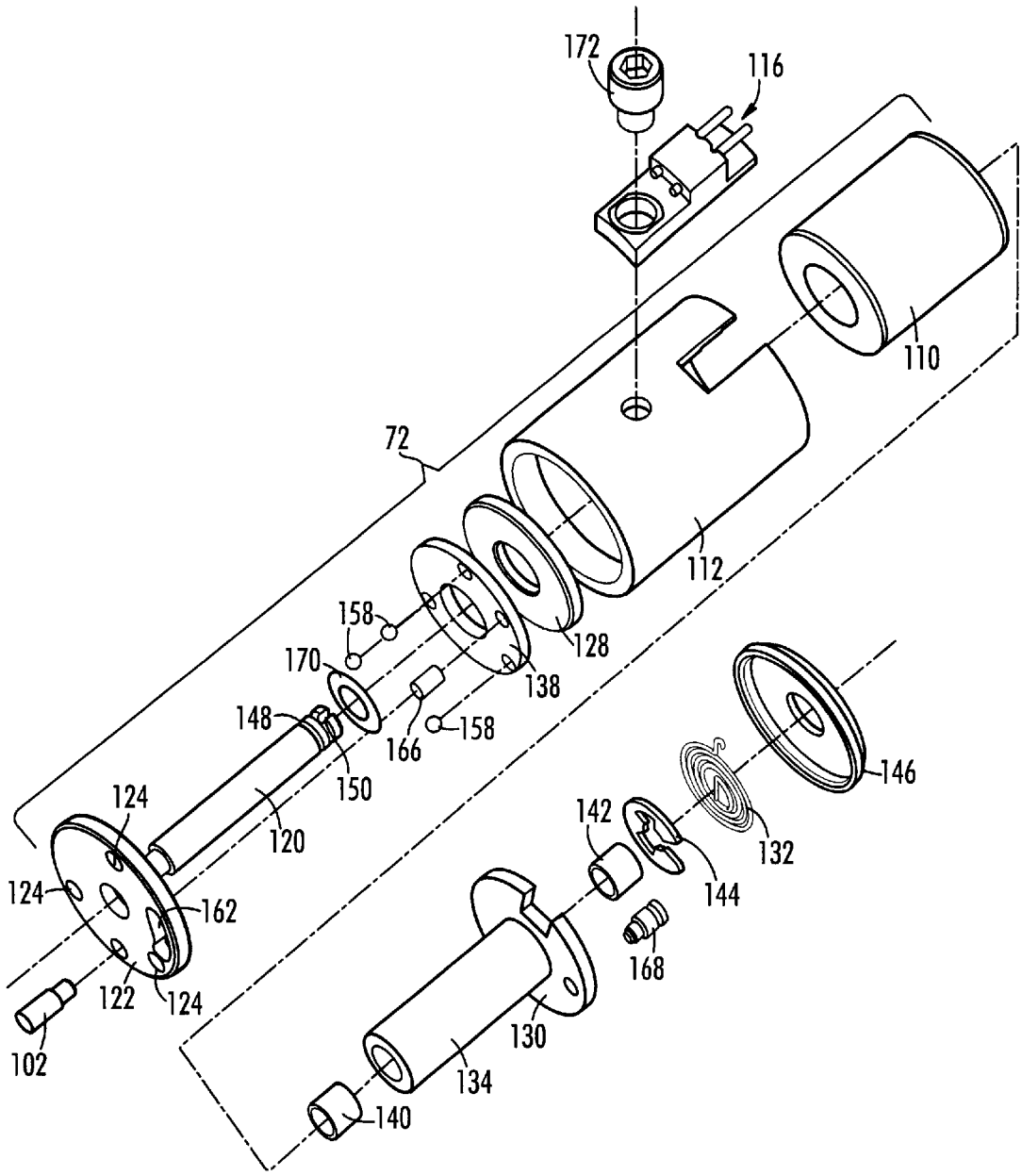
FIG. 5 is a perspective, exploded view of the brake solenoid of FIGS. 3A, 3B and 3C.

FIGS. 4A and 4B and 5 illustrate the present braking solenoid 72 and its operation. Solenoid 72, when activated, has a first or locked position, illustrated in FIG. 4A, and a second or unlocked and rotated position, illustrated in FIG. 4B. In the unlocked position, the armature assembly (items 122, 120, 102 FIG. 5) of solenoid 72 is free to rotate with respect to stator assembly (items 110, 112, 128, 138, 166, 140, 142, 134, 130 FIG. 5), which is held fixed. In the locked position, the armature assembly is prevented from rotating with respect to the stator assembly. Energizing solenoid 72 through a wire cartridge 116 carried by shell 112 and which brings electrical current via control circuitry 42 and wires leading from batteries 54 to coil 110, causes a force that moves the armature assembly axially with respect to the stator assembly into the locked position of solenoid 72. Deenergizing solenoid releases armature assembly and thereby allows pin 102 to be moved from the first position to the second position when trigger 30 is pulled.

Shaft 120 has a plate 122 on one end. Three holes 124 are formed on its periphery. Plate 122 also carries solenoid pin 102. A bearing plate 138 is carried by shell 112 in which three ball bearings 158 ride. The ball bearings are slightly larger in diameter than the thickness of plate 138. When the armature assembly is pulled magnetically toward bearing plate 138 by the activation of coil 110, the force created causes the ball bearings 158 to be captivated between holes 124 of plate 122 and the surface of plate 128. The ball bearings' radial locations are controlled by the holes of plate 138. The force applied thereby prevents the rotation of plate 122 with respect to bearing plate 138 because of the interlock between plates 122, 138 and 128 and the ball bearings 158. The solenoid will remain in this locked position (fire disable) as long as current is applied to the coil. The armature assembly is released from the locked position by removing the current to the coil, therefore removing the force that holds the ball bearings 158 in the holes 124 of plate 122. Therefore, when a rotary force is then applied to pin 102 by the cam surface 100 of trigger bar 62, plate 122 moves away from bearing plate 138, ball bearings 158 exit holes 124 in plate 122 and thereby allowing plate 122 to rotate freely to the second position (fire enable).

Thus, when trigger 30 is pulled by an unauthorized person, moving trigger bar 62 rearward, solenoid pin 102 is prevented from rotating because solenoid 72 is in its locked position and will cam trigger bar 62 downward. The downwardly cammed trigger bar 62 will fail to load sear 64 via sear driver pin 90.

When solenoid 72 is de-energized, armature assembly is allowed to move out from the stator assembly, against the urging of spring 132, just enough for ball bearings 158 to clear holes 124. With ball bearings 158 clear of holes 124, armature assembly is free to rotate. Because ball bearings 158 are indeed ball bearings, plate 122, when not being held against bearing plate 138, will free itself, with ball bearings 158 rolling out of holes 124. With plate 122 free to rotate, trigger bar 62 can maintain its rearward direction, rotating solenoid pin 102 out of its way.

Solenoid pin 102 and plate 122 rotate against the urging of a helical spring 132 which returns pin 102 and plate 122 to their original position once trigger 30 is released, allowing trigger bar 62 to return to its forwardmost position.

It will be apparent that the forces required to prevent solenoid pin 102 from rotating when plate 122 is in the locked position, or to allow it to rotate when plate 122 is in the unlocked position bear relationships to the forces supplied to trigger bar 62 by the user and required to cam trigger bar 62 downward. The force applied by the user to the rearward movement of trigger bar 62 must be sufficient to rotate plate 122 if plate 122 is in the unlocked position but not to rotate it if it is in the locked position. The force applied by solenoid pin 102 must also be sufficient to cam trigger bar 62 downward when plate 122 is held in place. Clearly also, the force required to rotate solenoid pin 102 against spring 132 should be small so that rotating it does not deflect trigger bar 62 from its rearward travel.

FIG. 5 illustrates the interior structure of solenoid 72 in an exploded view. In addition to solenoid pin 102, coil 110, shell 112, shaft 120, plate 122, holes 124, and end plate 128, solenoid 72 also includes a hub 134, with two sleeve bearings 140 and 142, an "E" ring 144, spring 132, an endcap 146, a pin 168, a spacer 170, and a wire cartridge bolt 172. Shaft 120 slides into hub 134 where shaft 120 is free to rotate against bearings 140, 142 while hub 134 is held in place by press fit into shell 112. "E" ring 144 secures hub 134 to shaft 120 at groove 148. Spring 132, which is a helical "watch" spring, has one end attached to shaft 120 at notch 150 and the other end secured by pin 168. Spacer 170 helps to hold shaft 120 in place in bearing plate 138. Endcap 146 holds spring 132 in place against flange 130 of hub 134. Wire cartridge 116 secured to shell 112 using wire cartridge bolt 172 carry electrical power to coil 110 through an opening in shell 112 from electrical control circuit 42 and batteries 54.

Plate 122 has a slot 162 that receives an alignment element 166 carried by bearing plate 138. As shaft 120 rotates, slot 162 rotates with it and alignment element moves from one extreme end of slot 162 in plate 122 to the other. Slot 162 thereby serves to limit the range of motion of plate 122 with respect to bearing plate 138 and thus the movement of solenoid pin 102. Spring 132 serves to return solenoid pin 102 once trigger 30 has been released and trigger bar 62 moves forward.

The preferred embodiment operates in accordance with a logic that is designed to fail in a "fire-enabled" mode so that a police officer can fire the firearm 10 just as if it were not equipped with an authorization system. This logic could easily be adapted to fail in a "fire disabled" mode for a sport gun, for example, when the life of the user does not depend on being able to fire. The logic is encoded into an integrated circuit carried by electrical control circuit 42.

Figure 6:
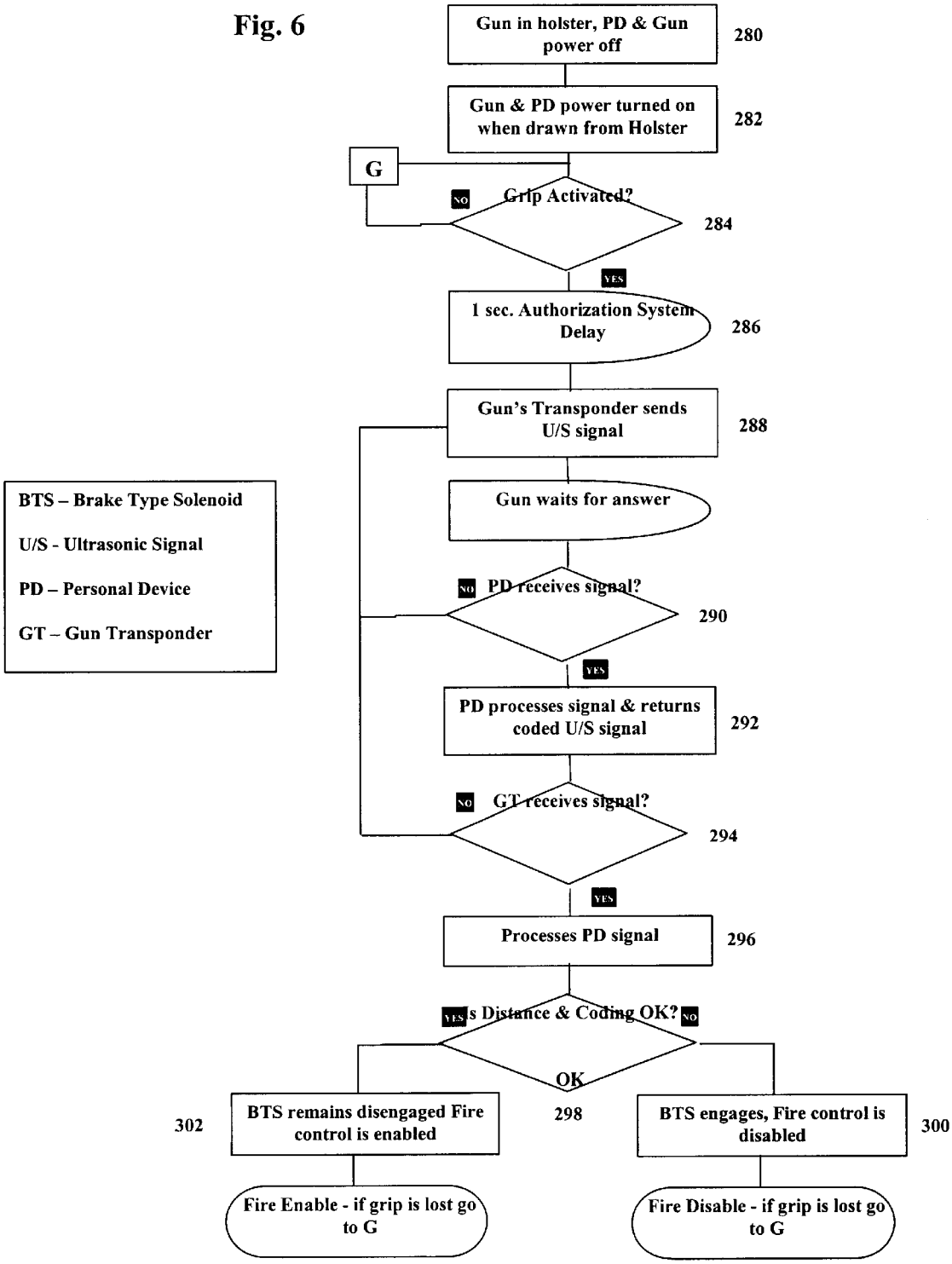
FIG. 6 is a logic flow chart illustrating the operation of the present firearm control system.

A firearm 10 initially may be in a holster 22 as indicated in box 280 of FIG. 6. Holster 22 is equipped with a magnet 26 that opens a holster switch 24, preferably a reed switch, to detect the presence of the fully seated firearm 10. The purpose of switch 24 is to disconnect batteries 54 (FIG. 1B)

when firearm 10 is in holster 22, that is, when firearm 10 is not required for immediate use, and to turn on batteries 54 when firearm 10 is withdrawn from holster 22. Whenever firearm 10 has been drawn out of holster 22 as shown in box 282, switch 24 closes (although, if firearm 10 is not being held for a sufficiently long period of time, batteries 54 will go into a "sleep mode," as will be more fully described below).

In holster 22 and upon being removed from it, however, the firing system is enabled and firearm 10 can be fired. Thus, removing firearm 10 from holster 22 closes holster switch 24 in order to draw power from batteries 54, but firearm 10 briefly continues to remain enabled, preferably for about one second after removal from holster 22.

Referring now to FIG. 6, which illustrates schematically the logic incorporated into electrical control circuit 42 in connection with holster switch 24, batteries 54 and pressure switches 56, power is initially off because firearm 10 is in holster 22 (box 280). Firearm 10 is in a "fire-enabled" mode. Upon drawing firearm 10 from holster (box 282) and closing grip switch (box 284), electrical control circuit 42 initiates a time delay (box 286)

For that short time while the timer marks off that delay interval, and during which delay interval the firing system is enabled and firearm 10 is in the hand of a user, whether authorized or not, firearm 10 may be fired. After that interval, which is preferably about one second, electrical control circuit 42 will then seek to determine if the person-gripping firearm 10 is authorized to fire it and to disable firearm 10 if the user is not authorized.

The purpose of enabling firearm 10 to fire for that brief interval is to allow a user to fire immediately after removing it from holster 22. Furthermore, in the event of a defective holster switch 24, pressure sensors 56, batteries 54 or electrical control circuit 42, the firearm 10 will still fire because it is in a "fire-enabled" mode when its systems fail. Those skilled in the art will readily understand how the logic presently being described can be altered for use in which failing in a "fire-enabled" mode can be changed to a "fire-disabled" mode. A fire-enabled mode is preferred for police use; a fire-disabled mode is preferred for sporting use and may be preferred by some for home security use.

The present logic system initiates the authorization system by sending an ultrasonic signal (box 288) to personal device 40 worn by an authorized user. This signal may be a coded or uncoded query. A coded query is preferred when other similar firearms will be operating in the vicinity of each other in order to prevent the corresponding personal devices from responding to signals from different firearms. Personal device 40 receives and processes the signal (box 290), and if the code is correct, responds with a coded authorization signal (box 292). The code can be any type of code carried by the ultrasonic carrier wave, either by frequency or amplitude modulation or coded pulses.

When firearm 10 receives the coded authorization signal (box 294), electrical control circuit 42 processes the signal (box 296) by checking the received code and the distance of the personal device 40 to firearm 10 to determine if the personal device has sent an authorized user's code, and if the distance from which the signal came are proper for firing (box 298). If the code is an authorized code and the distance is less than preselected distance "A" the firing system is enabled (box 300). If no signal or an incorrect signal is received or the distance to personal device 40 is greater than distance "A", the firing system is disabled (box 302).

After authorization, electrical control circuit 42 checks periodically to determine if pressure sensors 56 have stopped sensing pressure on handle 14 for more than a small amount of time. A user adjusting the grip on handle 14 of firearm 10 or changing hands will be ignored per the system logic if the time is short. If the grip switch is deactivated for more than a short, preselected period, most preferably about 0.3 seconds, the system detects a grip activation (box 284), skips the delay (box 286) because the gun was not drawn from the holster, undergoes re-authorization again (box 288) in order to verify that the user holding firearm 10 is still an authorized user and not an unauthorized user who has gained possession of firearm 10 from an authorized user.

If the user releases handle 14 of firearm 10 for a longer period of time, as for example, when inspecting gun 10 out of holster 22 or laying it down, pressure sensors 56 will be open but gun power switch will remain closed (power on). If firearm 10 is returned to holster 22, thereby opening holster switch 24, the firing system is enabled and batteries 54 will be switched off. If the user's grip has been released for a sufficiently long period of time but firearm 10 has not been placed in holster 22, firearm 10 is put into "sleep mode" to minimize drain on batteries 54. Once firearm 10 is re-gripped (box 284), skips the delay (box 286) because the gun was not drawn from the holster, reauthorization is started again (box 288).

If the authorization process is begun but the user is not authorized, the firing system will be disabled (box 302) and the authorization process will not be performed again as long as firearm 10 is gripped. The electrical control circuit 42 looks for deactivation of pressure sensors 56 for a short preselected interval, preferably a fraction of a second, and most preferably about 0.3 seconds, before initiating the reauthorization. If the user releases his grip for more than the preselected interval of time, re-griping will initiate reauthorization with box 286 being skipped.

In "sleep mode" all processing stops except the monitoring of pressure sensors 56. If pressure sensors 56 sense pressure on handle 14, electrical control circuit 42 comes out of sleep mode and initiates reauthorization with box 286 being skipped.

In summary of the logic, current is drawn from batteries 54 whenever firearm 10 is not in the holster 22. According to the preferred embodiment for police use, firearm 10 is designed to fail in the "fire-enabled" mode but to initiate authorization whenever pressure sensors 56 sense pressure on handle 14, except for very brief switch openings, such as a shifting of the user's grip. Only if the user is not authorized by a signal from the personal device 40 will firearm 10 be disabled. Firearm 10 may be fired without authorization within a short time right after it is removed from holster 22.

It will be apparent to those skilled in firearm authorization systems that many modifications and substitutions can be made to the foregoing preferred embodiments without departing from the spirit and scope of the present invention, defined by the appended claims.

What is claimed is:

1. A firearm, comprising:

a frame;

a barrel carried by said frame;

fire control means carried by said frame and adapted to be able to fire a round of ammunition through said barrel;

a brake solenoid carried by said frame having a locked position and an unlocked position, and wherein said brake solenoid disables said fire control means by disconnecting said fire control means when said brake solenoid is in said locked position; and authorizing means for verifying authorization of a user, said authorizing means being carried by said frame, said brake solenoid responsive to signals from said authorizing means so that said brake solenoid is moved to said unlocked position and said fire control means is enabled when so signaled by said authorizing means and said brake solenoid is moved to said locked position and said fire control means is disabled when so signaled by said authorizing means.

2. The firearm as recited in claim 1, wherein said fire control means includes a trigger, a trigger bar responsive to movement of said trigger, and a sear responsive to movement of said trigger bar, and wherein said brake solenoid disconnects said fire control means by camming said trigger bar out of engagement with said sear when said brake solenoid is in said locked position.

3. The firearm as recited in claim 1, wherein said brake solenoid includes a armature assembly having holes and a stator assembly having holes and ball bearings between said armature assembly and said stator assembly, and wherein said ball bearings are captured between said holes when said brake solenoid is in said locked position.

4. The firearm as recited in claim 3, wherein said armature assembly is free to rotate when said ball bearings are not captured between said holes.

5. The firearm as recited in claim 3, wherein said fire control means includes a trigger, a trigger bar responsive to movement of said trigger, and a sear responsive to movement of said trigger bar, and wherein said armature assembly carries a solenoid pin, and wherein said pin engages said trigger bar when said trigger bar responds to said movement of said trigger.

6. The firearm as recited in claim 1, wherein said brake solenoid carries a armature assembly and wherein said armature assembly rotates when said brake solenoid is in said unlocked position and does not rotate when said brake solenoid is in said locked position.

7. The firearm as recited in claim 1, wherein said brake solenoid has an armature assembly and means for urging said armature assembly to rotate from a first position to a second position when said authorizing means enables said fire control means.

8. The firearm as recited in claim 7, wherein said armature assembly has holes and wherein said brake solenoid has a stator assembly having holes and ball bearings between said armature assembly and said stator assembly, and wherein said ball bearings are captured between said holes of said armature assembly and said stator assembly when said brake solenoid is in said locked position and said armature assembly is in said first position.

9. A firearm, comprising:

a frame;

a barrel carried by said frame;

a trigger carried by said frame;

a trigger bar carried by said frame and responsive to movement of said trigger;

a sear carried by said frame and responsive to movement of said trigger bar;

a firing pin loadable by movement of said sear, said firing pin able to fire a round of ammunition from said barrel;

a brake solenoid carried by said frame, said brake solenoid having a solenoid pin engaging said trigger bar, said brake solenoid having a locked position wherein said solenoid pin cams said trigger bar out of engagement with said sear and an unlocked position wherein said solenoid pin does not cam said trigger bar out of engagement with said sear;

authorizing means for verifying authorization of a user, said authorizing means being carried by said frame, said brake solenoid being moved to said locked position when said user is not authorized and being moved to said unlocked position when said user is authorized.

10. The firearm as recited in claim 9, wherein said brake solenoid has a stator assembly and an armature assembly rotatably mounted to said stator assembly and ball bearings between said armature assembly and said stator assembly, and wherein said stator assembly and said armature assembly carry means for preventing rotation of said armature assembly with respect to said stator assembly when said ball bearings are captured between said armature assembly and said stator assembly when said brake solenoid is in said locked position.

11. The firearm as recited in claim 9, wherein said trigger bar has a camming edge and wherein said brake solenoid pin engages said camming edge.

12. The firearm as recited in claim 11, wherein said solenoid pin is movable by said camming edge when said brake solenoid is in said unlocked position and is not movable when said brake solenoid is in said locked position.

13. The firearm as recited in claim 11, wherein said solenoid pin disconnects said trigger bar from said sear so that said sear does not move when said trigger bar moves in response to movement of said trigger when said brake solenoid is in said locked position.

14. A firearm, comprising:

a frame;

a barrel carried by said frame;

a trigger carried by said frame;

a trigger bar carried by said frame and responsive to movement of said trigger, said trigger bar having a camming edge;

a sear carried by said frame and responsive to movement of said trigger bar;

a firing pin loadable by movement of said sear, said firing pin able to fire a round of ammunition from said barrel;

a brake solenoid carried by said frame, said brake solenoid having a stator assembly, a armature assembly rotatable within said stator assembly, and a solenoid pin carried by said armature assembly, said solenoid pin engaging said camming edge of said trigger bar, said brake solenoid having a locked position wherein said solenoid pin cams said trigger bar away from said sear and an unlocked position wherein said solenoid pin does not cam said trigger bar from said sear; and authorizing means for verifying authorization of a user, said authorizing means being carried by said frame, said brake solenoid being moved to said locked position when said user is not authorized and being moved to said unlocked position when said user is authorized.

15. The firearm as recited in claim 14, wherein said armature assembly rotates when said brake solenoid is in said unlocked position and does not rotate when said armature assembly is in said locked position.

16. The firearm as recited in claim 14, wherein said armature assembly has holes formed through and said stator assembly has holes formed through and ball bearings between said armature assembly and said stator assembly, said ball bearings being captured between said holes when said brake solenoid is in said locked position.

17. The firearm as recited in claim 14, wherein said armature assembly rotates between a first position and a second position and wherein said brake solenoid further comprises means for urging said plate to rotate back to said first position from said second position.

18. The firearm as recited in claim 17, wherein said armature assembly is in said first position when said brake solenoid is in said locked position.

19. The firearm as recited in claim 14, further comprising pressure sensors carried by said handle, said authorization system being responsive to signals from said pressure sensors.

20. The firearm as recited in claim 19, wherein said pressure sensors include at least three pressure sensors and wherein said authorization system responds to a signal from any one pressure sensor of said multiple pressure sensors.

* * * * *